US011084317B1

(12) United States Patent
Flores et al.

(10) Patent No.: US 11,084,317 B1
(45) Date of Patent: Aug. 10, 2021

(54) WRITING UTENSIL ASSEMBLY

(71) Applicants: David Flores, Kissimmee, FL (US); Daniel Flores, Kissimmee, FL (US)

(72) Inventors: David Flores, Kissimmee, FL (US); Daniel Flores, Kissimmee, FL (US)

( * ) Notice: Subject to any disclaimer, the term of this patent is extended or adjusted under 35 U.S.C. 154(b) by 0 days.

(21) Appl. No.: 16/748,223

(22) Filed: Jan. 21, 2020

(51) Int. Cl.
*B65D 85/28* (2006.01)
*B43K 23/00* (2006.01)
*B43K 29/00* (2006.01)

(52) U.S. Cl.
CPC ..... *B43K 23/001* (2013.01); *B43K 29/00* (2013.01); *B65D 85/28* (2013.01)

(58) Field of Classification Search
CPC .. B43K 23/001; B43K 23/002; B43K 23/016; B43K 23/06; B43K 29/00; B43K 29/004; B43K 29/007; B43K 29/10; B43K 29/18; B65D 85/20; B65D 85/24; B65D 85/28
USPC ..... 401/195, 48, 131; D19/78, 77, 85
See application file for complete search history.

(56) References Cited

U.S. PATENT DOCUMENTS 3,159,372 A * 12/1964 McIntosh ..... A47G 1/17 248/683
D262,121 S 12/1981 Brady
5,072,483 A * 12/1991 Durand ..... B43K 23/12 15/210.1
D366,282 S 1/1996 Adams
6,022,159 A * 2/2000 Kossnar ..... B43K 23/12 211/69.5
D484,199 S 12/2003 Weiser
D486,058 S 2/2004 Fahy
D487,112 S 2/2004 Meng
D497,646 S 10/2004 Danon
6,971,812 B1 * 12/2005 Chen ..... B43K 29/00 401/195
D518,532 S 4/2006 Weiser
D640,743 S 6/2011 Guirlinger
2005/0086810 A1 4/2005 Danon
2010/0202822 A1 * 8/2010 Smith ..... B43M 99/009 401/195

* cited by examiner

*Primary Examiner* — David J Walczak

(57) ABSTRACT

A ornamental writing utensil assembly includes a housing has a writing well therein to receive an elongated writing utensil. Additionally, the housing has a rod well therein. A mating member is coupled to the housing and the mating member releasably engages a support surface for storing the housing. A rod is insertable into the rod well and a pair of wings that each movably engages the rod to enhance the ornamental appearance of the writing utensil. A plurality of couplers is each coupled to a respective one of the wings. Each of the couplers movably engages the rod for retaining each of the wings on the rod.

6 Claims, 9 Drawing Sheets

WRITING UTENSIL ASSEMBLY

CROSS-REFERENCE TO RELATED APPLICATIONS

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to writing utensil devices and more particularly pertains to a new writing utensil device for enhancing the ornamental appearance of a writing utensil.

(2) Description of Related Art Including Information Disclosed Under 37 CFR 1.97 and 1.98

The prior art relates to writing utensil devices. The prior art discloses a scissor holder that is structured to resemble butterfly wings. The prior art discloses a pencil holder that has the structure of a four-legged mammal. Additionally, the prior art discloses a writing utensil holder that has the ornamental appearance of a ginger bread man. The prior art also discloses a variety of artificial butterflies for ornamental purposes.

BRIEF SUMMARY OF THE INVENTION

An embodiment of the disclosure meets the needs presented above by generally comprising a housing has a writing well therein to receive an elongated writing utensil. Additionally, the housing has a rod well therein. A mating member is coupled to the housing and the mating member releasably engages a support surface for storing the housing. A rod is insertable into the rod well and a pair of wings that each movably engages the rod to enhance the ornamental appearance of the writing utensil. A plurality of couplers is each coupled to a respective one of the wings. Each of the couplers movably engages the rod for retaining each of the wings on the rod.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
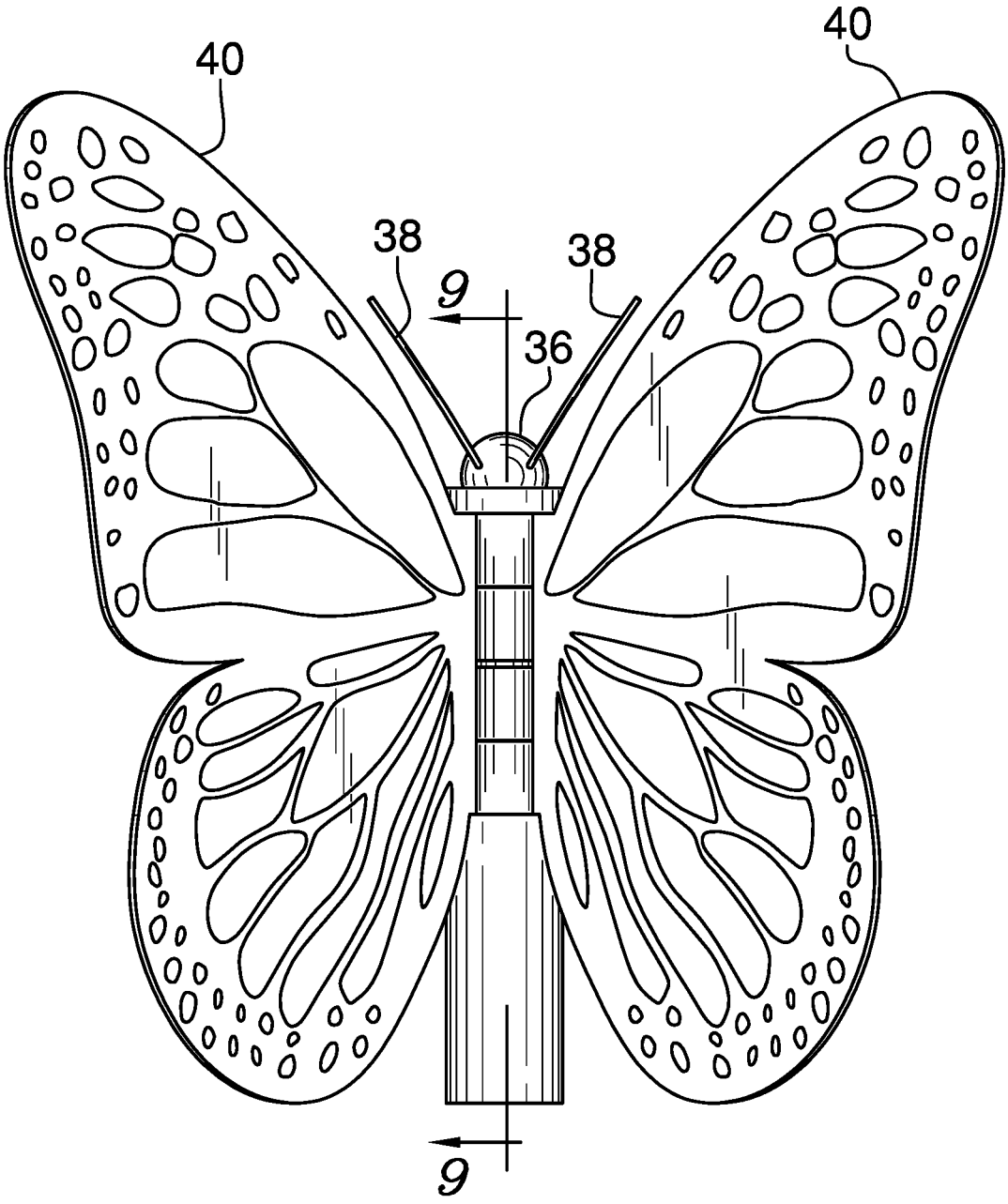
FIG. 1 is a back view of an ornamental writing utensil assembly according to an embodiment of the disclosure.
Figure 2:
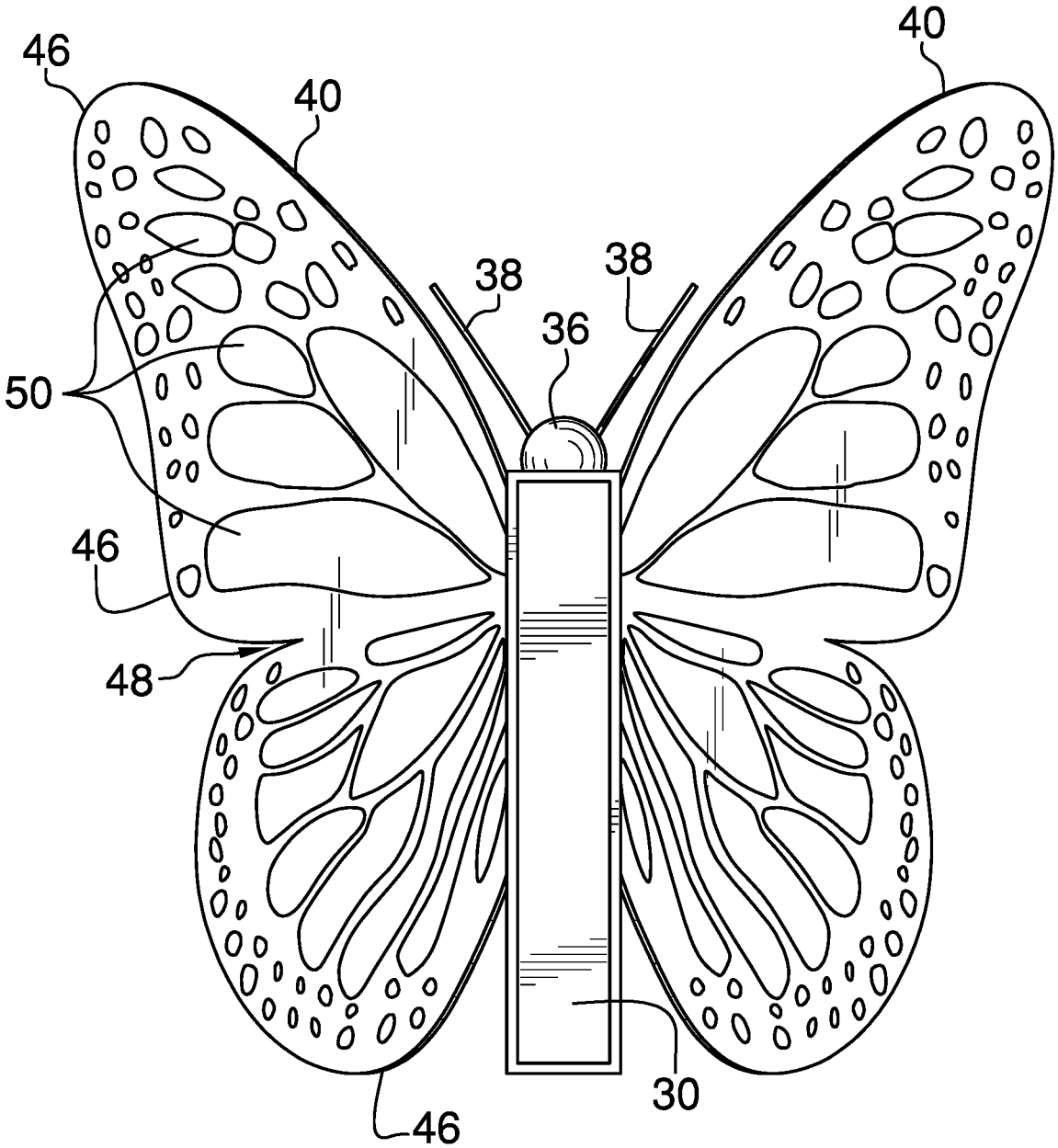
FIG. 2 is a front view of an embodiment of the disclosure.
Figure 3:
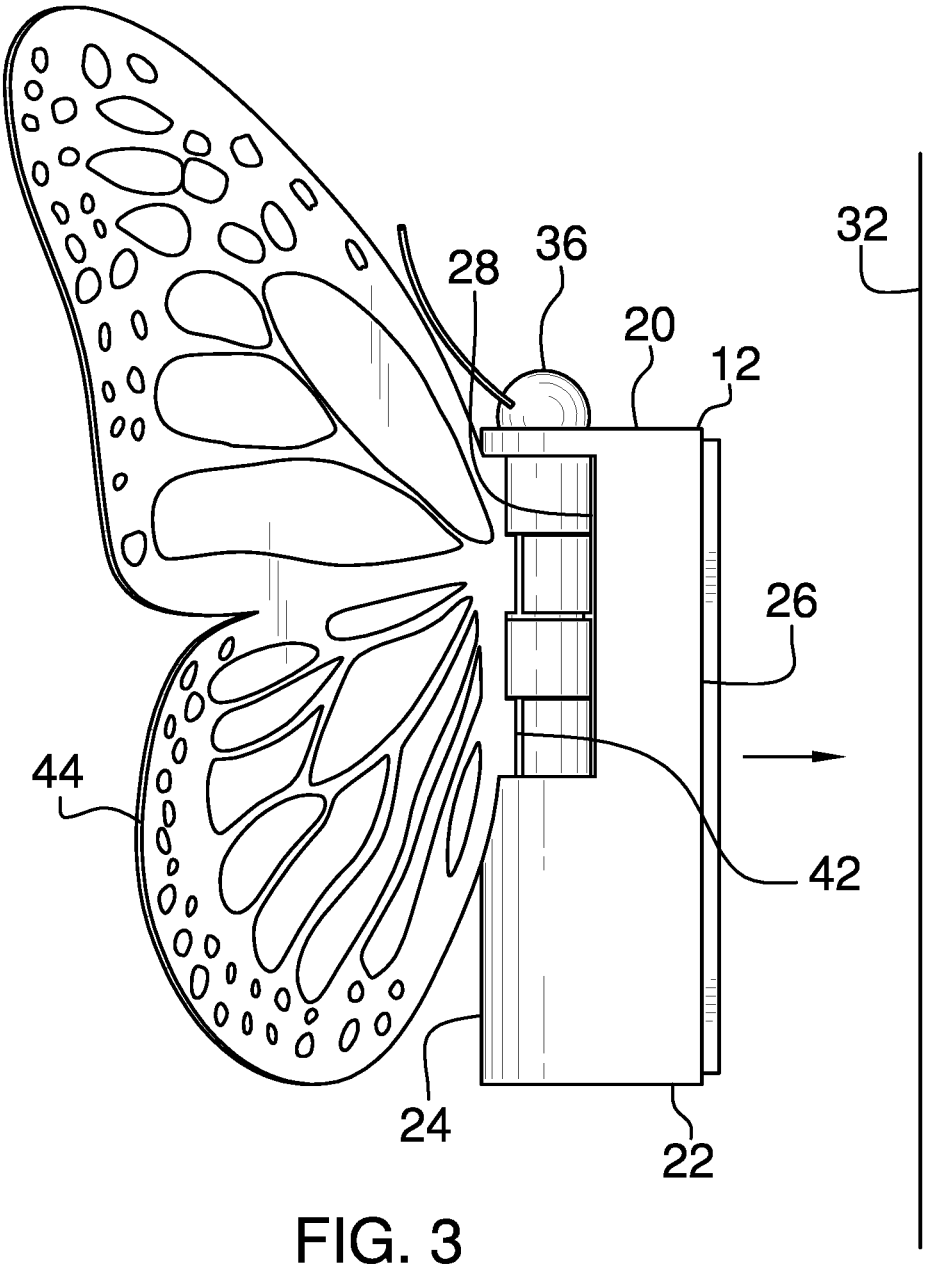
FIG. 3 is a right side view of an embodiment of the disclosure.
Figure 4:
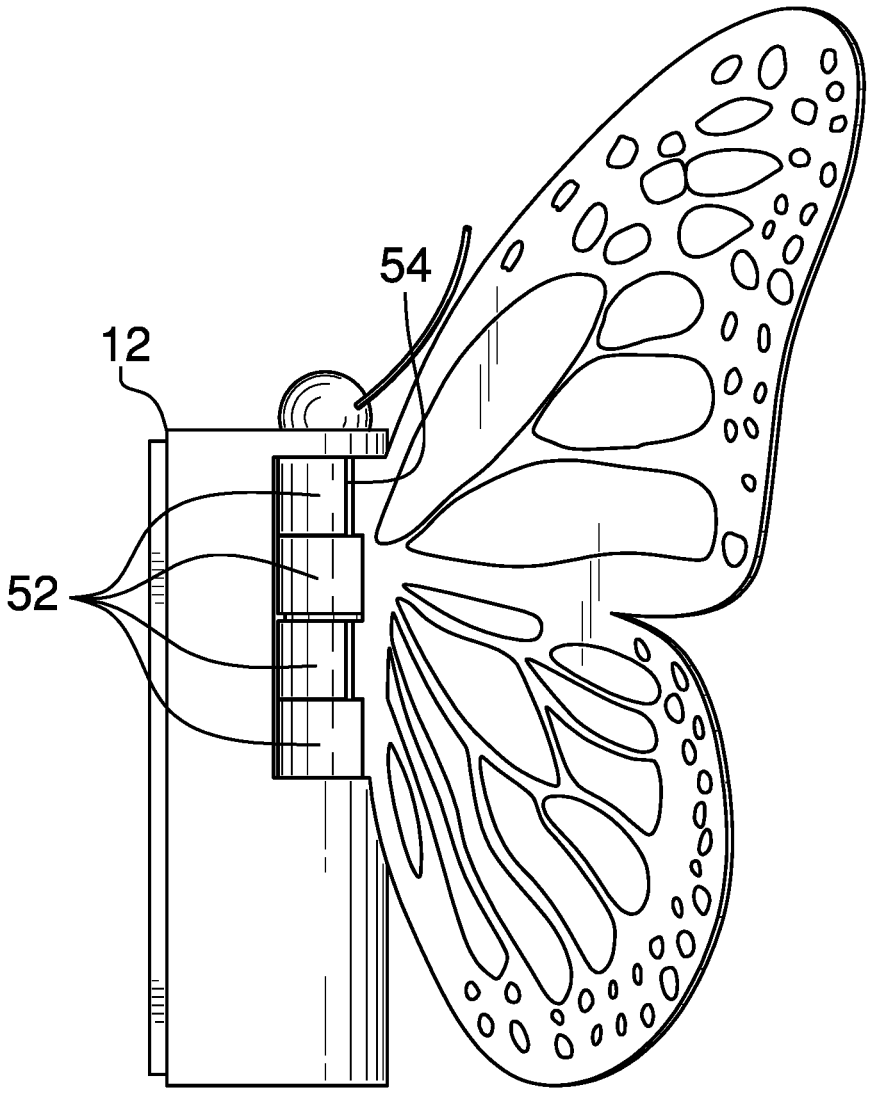
FIG. 4 is a left side view of an embodiment of the disclosure.
Figure 5:
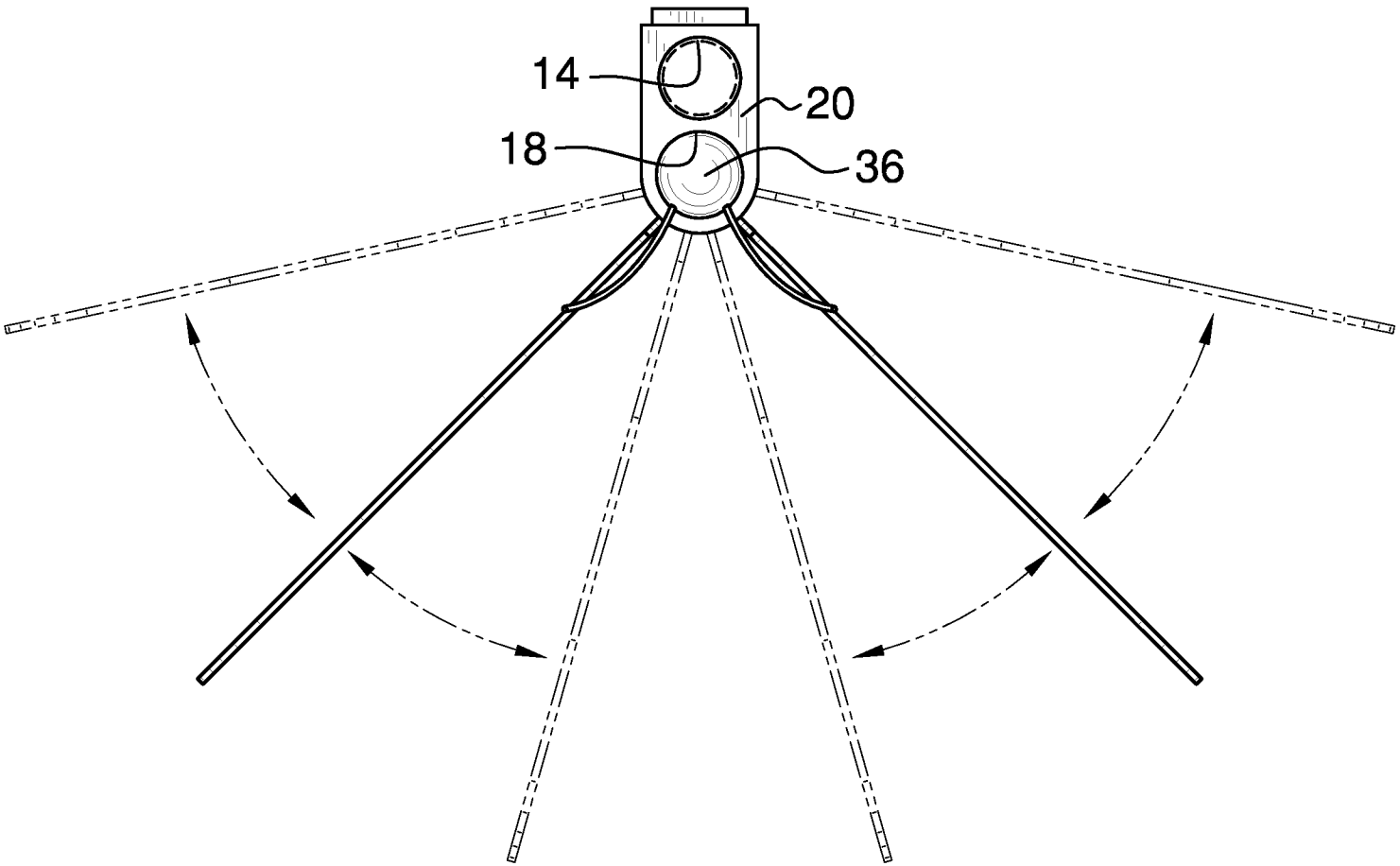
FIG. 5 is a top view of an embodiment of the disclosure.
Figure 6:
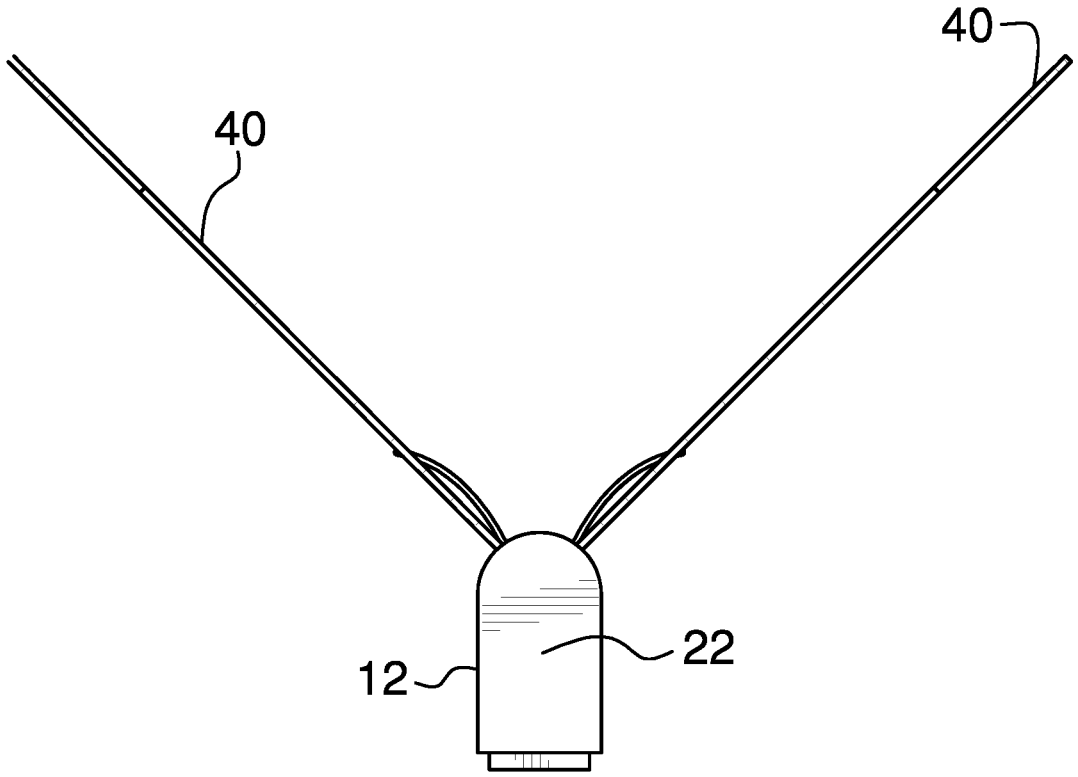
FIG. 6 is a bottom view of an embodiment of the disclosure.
Figure 7:
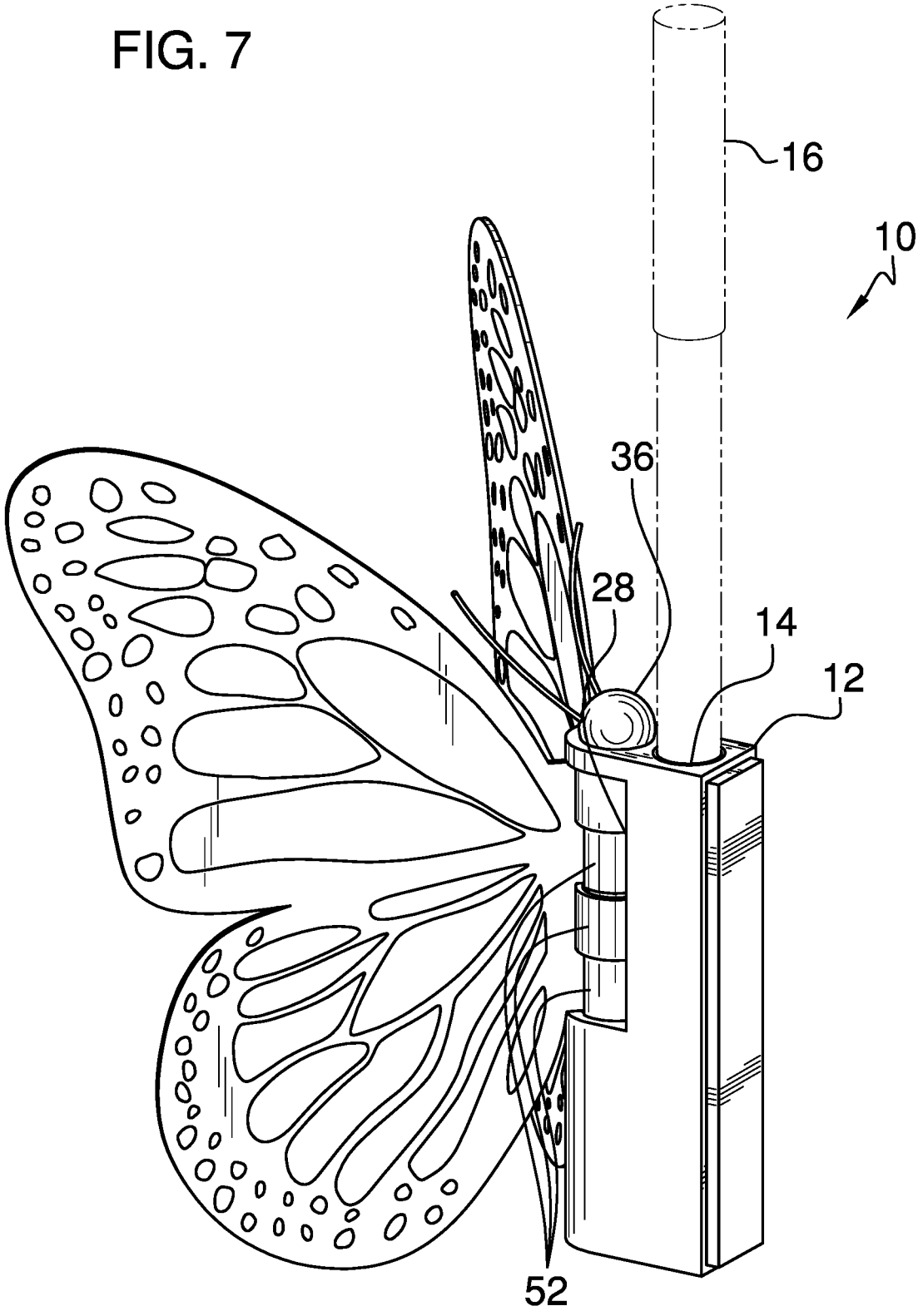
FIG. 7 is a perspective in-use view of an embodiment of the disclosure.
Figure 8:
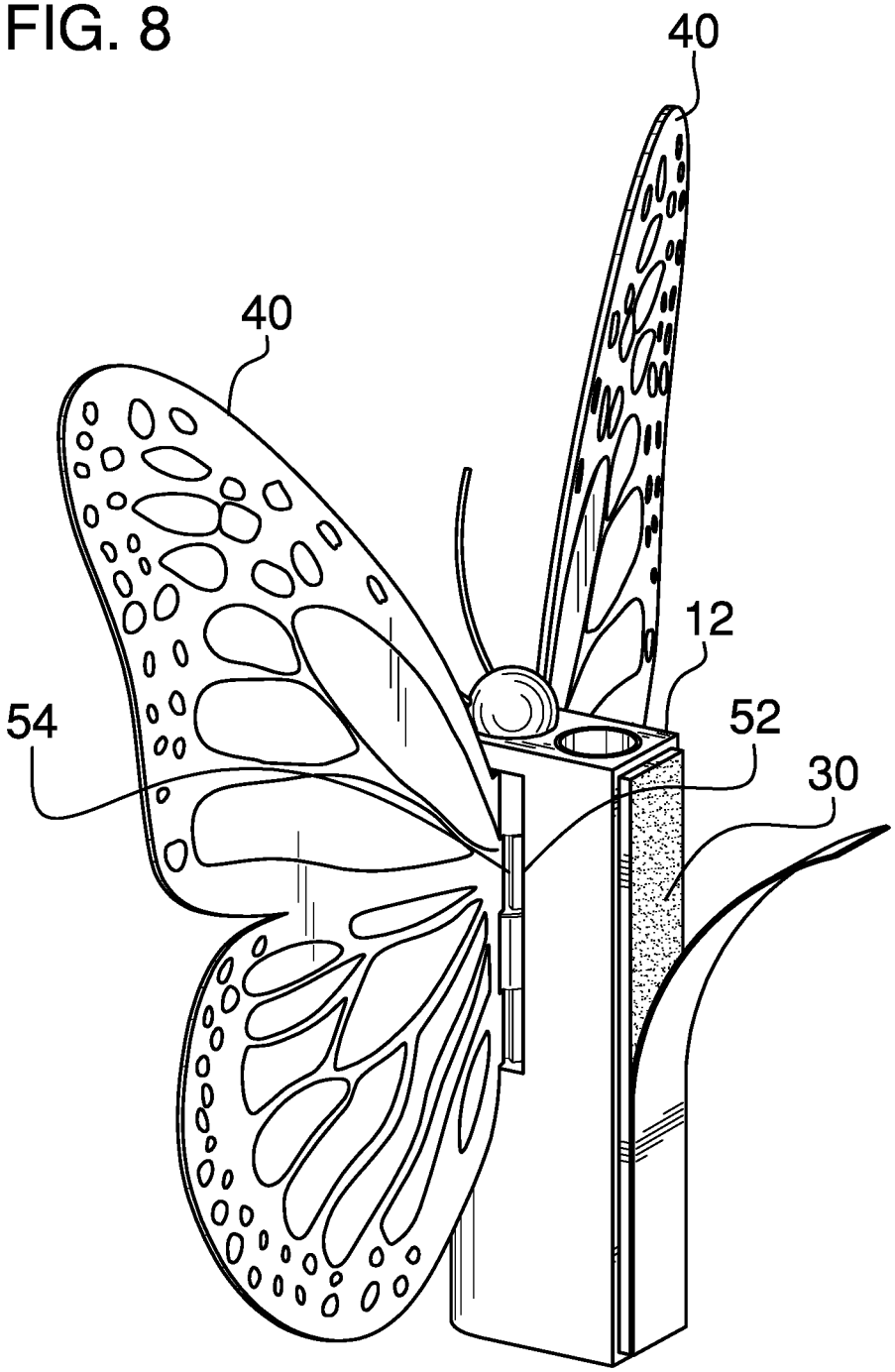
FIG. 8 is a front perspective view of an embodiment of the disclosure.
Figure 9:
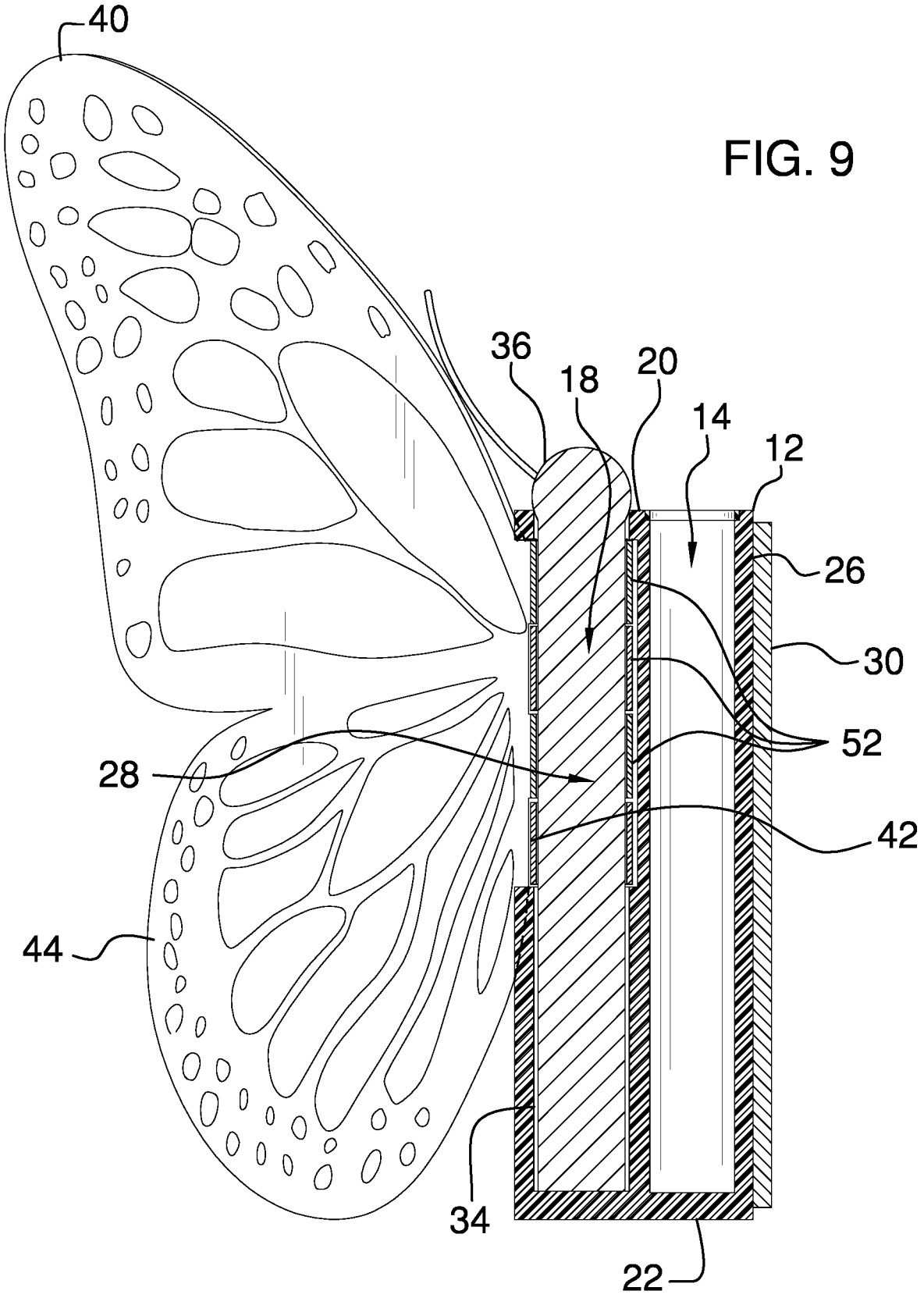
FIG. 9 is a cross sectional view taken along line of an embodiment of the disclosure.

With reference now to the drawings, and in particular to FIGS. 1 through 9 thereof, a new writing utensil device embodying the principles and concepts of an embodiment of the disclosure and generally designated by the reference numeral 10 will be described.

As best illustrated in FIGS. 1 through 9, the ornamental writing utensil assembly 10 generally comprises a housing 12 that has a writing well 14 therein to receive an elongated writing utensil 16. The housing 12 has a rod well 18 therein and the housing 12 has a top end 20, a bottom end 22, a rear surface 24 and a front surface 26. The housing 12 is elongated between the top end 20 and the bottom end 22 and the writing well 14 extends through the top end 20 toward the bottom end 22. The rod well 18 extends through the top end 20 toward the bottom end 22 and the rear surface 24 has an opening 28 intersecting the rod well 18.

A mating member 30 is coupled to the housing 12 and the mating member 30 releasably engages a support surface 32 for storing the housing 12. The mating member 30 is positioned on the front surface 26 of the housing 12 and the mating member 30 extends substantially between the top end 20 and the bottom end 22. The mating member 30 may comprise a magnet, a multiple use adhesive strip or any other type of similar mating member.

A rod 34 is insertable into the rod well 18 and the rod 34 has a head 36 thereon. The head 36 has a diameter that is greater than a diameter of the rod well 18 such that the head 36 inhibits the rod 34 from passing fully into the rod well 18. A pair of antennae 38 is each coupled to and extends from the head 36 on the rod 34 to give the head 36 the ornamental appearance of a butterfly head.

A pair of wings 40 is provided and each of the wings 40 movably engages the rod 34 to enhance the ornamental appearance of the writing utensil 16. Each of the wings 40 has a first edge 42 and a second edge 44, and the second edge 44 has a plurality of curves 46 and indentations 48 thereby facilitating each of the wings 40 to resemble a butterfly wing. Each of the wings 40 has indicia 50 printed thereon and the indicia 50 on each of the wings 40 comprise imagery of ornamental patterns commonly found on butterfly wings.

A plurality of couplers 52 is provided and each of the couplers 52 is coupled to a respective one of the wings 40. Each of the couplers 52 movably engages the rod 34 for retaining each of the wings 40 on the rod 34 and each of the couplers 52 is positioned on the first edge 42 of the respective wing 40. Each of the couplers 52 has a distal end 54 with respect to the first edge 42. Moreover, each of the couplers 52 is concavely arcuate between the first edge 42 and the distal end 54 thereby facilitating each of the couplers 52 to conform to the curvature of the rod 34. Each of the couplers 52 passes through the opening 28 in the rear surface 24 of the housing 12.

In use, the writing utensil 16 is inserted into the writing well 14 in the housing 12. In this way the wings 40 enhance the ornamental appearance of the writing utensil 16. Additionally, the wings 40 make the writing utensil 16 stand out from surrounding objects thereby enhancing locating the writing utensil 16. The wings 40 can be positioned at any preferred orientation on the rod 34 to enhance joy for the user of the writing utensil 16. The mating member 30 facilitates the writing utensil 16 to be stored on a support surface 32 such as a wall or a table top.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. An ornamental writing utensil assembly being configured to incorporate butterfly wings on a writing utensil, said assembly comprising:

a housing having a writing well therein wherein said writing well is configured to receive an elongated writing utensil, said housing having a rod well therein;

a mating member being coupled to said housing, said mating member releasably engaging a support surface for storing said housing;

a rod being insertable into said rod well, wherein said rod has a head thereon, said head having a diameter being greater than a diameter of said rod well such that said head inhibits said rod from passing fully into said rod well;

a pair of wings, each of said wings movably engaging said rod wherein each of said wings is configured to enhance the ornamental appearance of the writing utensil; and a plurality of couplers, each of said couplers being coupled to a respective one of said wings, each of said couplers movably engaging said rod for retaining each of said wings on said rod.

2. The assembly according to claim 1, wherein: An ornamental writing utensil assembly being configured to incorporate butterfly wings on a writing utensil, said assembly comprising:

a housing having a writing well therein wherein said writing well is configured to receive an elongated writing utensil, said housing having a rod well therein;

a mating member being coupled to said housing, said mating member releasably engaging a support surface for storing said housing;

a rod being insertable into said rod well;

a pair of wings, each of said wings movably engaging said rod wherein each of said wings is configured to enhance the ornamental appearance of the writing utensil;

a plurality of couplers, each of said couplers being coupled to a respective one of said wings, each of said couplers movably engaging said rod for retaining each of said wings on said rod;

wherein said housing has a top end, a bottom end, a rear surface and a front surface, said housing being elongated between said top end and said bottom end, said writing well extending through said top end toward said bottom end, said rod well extending through said top end toward said bottom end, said rear surface having an opening intersecting said rod well; and wherein said mating member is positioned on said front surface of said housing, said mating member extending substantially between said top end and said bottom end.

3. The assembly according to claim 1, further comprising a pair of antennae, each of said antennae being coupled to and extending from said head on said rod wherein said pair of antennae are configured to give said head the ornamental appearance of a butterfly head.

4. An ornamental writing utensil assembly being configured to incorporate butterfly wings on a writing utensil, said assembly comprising:

a housing having a writing well therein wherein said writing well is configured to receive an elongated writing utensil, said housing having a rod well therein;

a mating member being coupled to said housing, said mating member releasably engaging a support surface for storing said housing;

a rod being insertable into said rod well;

a pair of wings, each of said wings movably engaging said rod wherein each of said wings is configured to enhance the ornamental appearance of the writing utensil;

a plurality of couplers, each of said couplers being coupled to a respective one of said wings, each of said couplers movably engaging said rod for retaining each of said wings on said rod; and wherein each of said wings has a first edge and a second edge, said second edge having a plurality of curves and indentations thereby facilitating each of said wings to resemble a butterfly wing, each of said wings having indicia printed thereon, said indicia on each of said wings comprising imagery of ornamental patterns commonly found on butterfly wings.

5. The assembly according to claim 4, wherein each of said couplers is positioned on said first edge of said respective wing, each of said couplers having a distal end with respect to said first edge, each of said couplers being concavely arcuate between said first edge and said distal end thereby facilitating each of said couplers to conform to a curvature of said rod, each of said couplers passing through an opening in a rear surface of said housing.

6. The assembly according to claim 1, further comprising:

said housing having a top end, a bottom end, a rear surface and a front surface, said housing being elongated between said top end and said bottom end, said writing well extending through said top end toward said bottom end, said rod well extending through said top end toward said bottom end, said rear surface having an opening intersecting said rod well;

said mating member being positioned on said front surface of said housing, said mating member extending substantially between said top end and said bottom end;

a pair of antennae, each of said antennae being coupled to and extending from said head on said rod wherein said pair of antennae are configured to give said head the ornamental appearance of a butterfly head;

each of said wings having a first edge and a second edge, said second edge having a plurality of curves and indentations thereby facilitating each of said wings to resemble a butterfly wing, each of said wings having indicia printed thereon, said indicia on each of said wings comprising imagery of ornamental patterns commonly found on butterfly wings; and each of said couplers being positioned on said first edge of said respective wing, each of said couplers having a distal end with respect to said first edge, each of said couplers being concavely arcuate between said first edge and said distal end thereby facilitating each of said couplers to conform to a curvature of said rod, each of said couplers passing through said opening in said rear surface of said housing.

* * * * *